US010239223B2

(12) United States Patent
Mathon

(10) Patent No.: US 10,239,223 B2
(45) Date of Patent: Mar. 26, 2019

(54) CUTTING TABLE FOR CUTTING A FIBER PREFORM OBTAINED BY THREE-DIMENSIONAL WEAVING, AND A CUTTING METHOD USING SUCH A TABLE

(71) Applicant: SNECMA, Paris (FR)

(72) Inventor: Richard Mathon, Brunoy (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 15/103,229

(22) PCT Filed: Dec. 1, 2014

(86) PCT No.: PCT/FR2014/053092
§ 371 (c)(1),
(2) Date: Jun. 9, 2016

(87) PCT Pub. No.: WO2015/086947
PCT Pub. Date: Jun. 18, 2015

(65) Prior Publication Data

US 2016/0375601 A1 Dec. 29, 2016

(30) Foreign Application Priority Data

Dec. 11, 2013 (FR) ..... 13 62408

(51) Int. Cl.
*B26F 1/00* (2006.01)
*B26F 3/00* (2006.01)
(Continued)

(52) U.S. Cl.
CPC ..... *B26D 7/20* (2013.01); *B26F 3/008* (2013.01); *D06H 7/00* (2013.01); *D06H 7/24* (2013.01); *B26F 2210/12* (2013.01); *Y10T 83/68* (2015.04)

(58) Field of Classification Search
CPC ..... B26D 7/20; B26F 3/008; B26F 2210/12; Y10T 83/875; Y10T 83/68; D06H 7/00; D06H 7/24
(Continued)

(56) References Cited

U.S. PATENT DOCUMENTS 572,320 A * 12/1896 Stuparich ..... B26D 7/0006 83/565
2,325,311 A * 7/1943 Ducklo ..... B21D 28/14 83/176
(Continued)

FOREIGN PATENT DOCUMENTS

CN 201424599 Y 3/2010
EP 2 006 074 A1 12/2008
(Continued)

OTHER PUBLICATIONS

International Preliminary Report on Patentability and the Written Opinion of the International Searching Authority as issued in International Patent Application No. PCT/FR2014/053092, dated Jun. 14, 2016.
(Continued)

*Primary Examiner* — Laura M Lee
(74) *Attorney, Agent, or Firm* — Pillsbury Winthrop Shaw Pittman LLP

(57) ABSTRACT

A cutting table for cutting out a fiber preform obtained by three-dimensional weaving and having two portions that are connected together by at least one zone of non-interlinking and that present outlines of different shapes, includes a tabletop provided with a recess for receiving one of the portions of the fiber preform to be cut out. The fiber preform is capable of laying flat in the access. The cutting table further includes sacrificial plates for interposing between the portions of the fiber preform for cutting out and for being fastened to the tabletop. The sacrificial plates are capable of
(Continued)

covering partially the recess of the tabletop while being fastened to the tabletop. The cutting table also includes a cutting template configured to be pressed against a portion of the fiber preform that is positioned outside of the recess, and a device for applying compacting pressure against the cutting template.

17 Claims, 8 Drawing Sheets

(51) Int. Cl.
*B26D 7/20* (2006.01)
*D06H 7/24* (2006.01)
*D06H 7/00* (2006.01)

(58) Field of Classification Search
USPC ..... 83/547, 31, 19, 565
See application file for complete search history.

(56) References Cited

U.S. PATENT DOCUMENTS 2,654,428 A * 10/1953 Martincic ..... B21D 28/14 83/222
4,611,519 A * 9/1986 Hagerty ..... B23D 15/002 83/143
5,746,104 A * 5/1998 Russell ..... B26F 1/14 83/684
2013/0216770 A1 8/2013 Gilbertson et al.
2014/0366386 A1* 12/2014 Brisson ..... F24F 13/0245 30/273

FOREIGN PATENT DOCUMENTS

WO WO 2006/136755 A2 12/2006
WO WO 2010/130253 A2 11/2010

OTHER PUBLICATIONS

International Search Report as issued in International Patent Application No. PCT/FR2014/053092, dated Jan. 30, 2015.

* cited by examiner

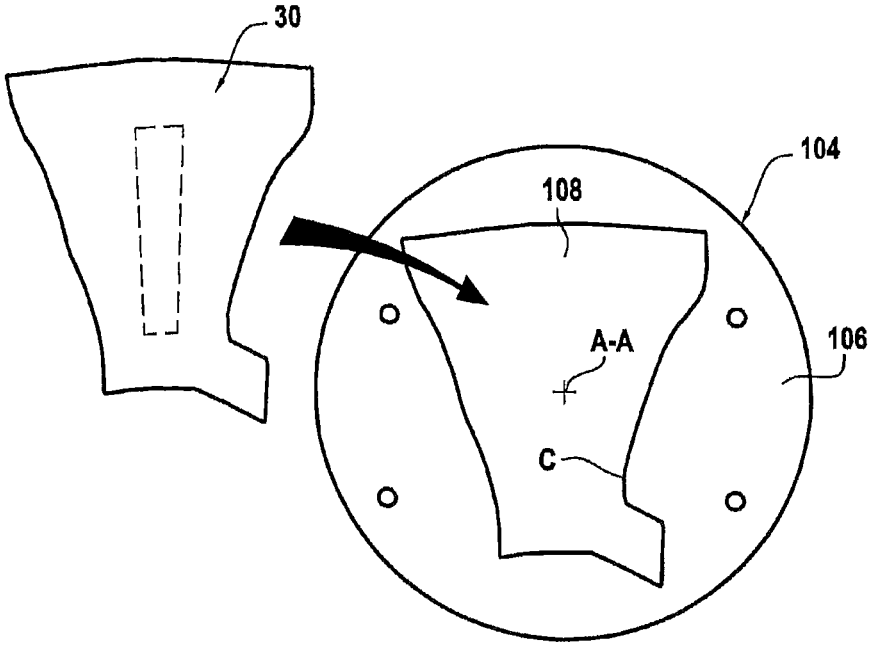
FIG.4
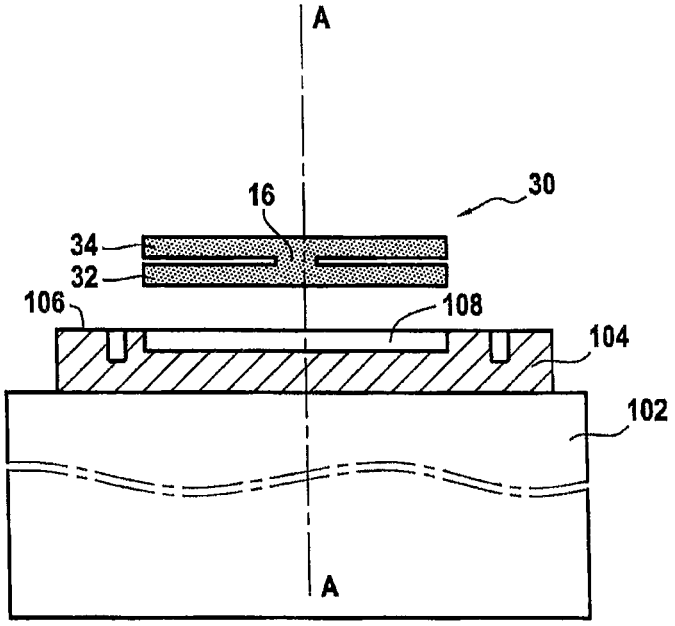

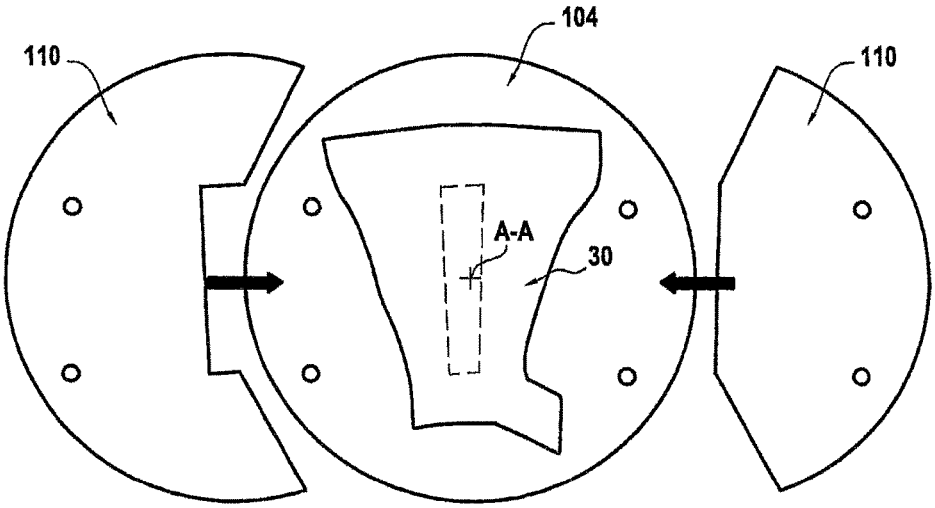
FIG.5
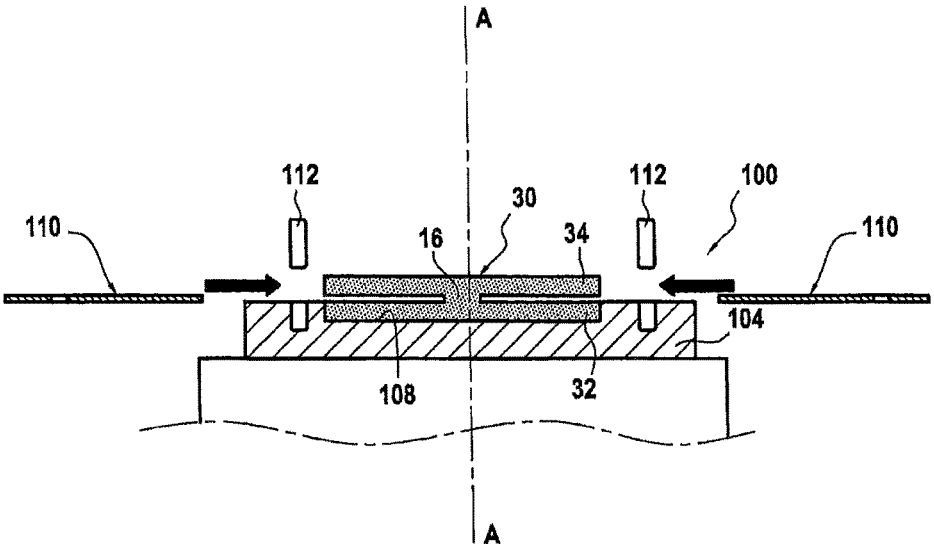

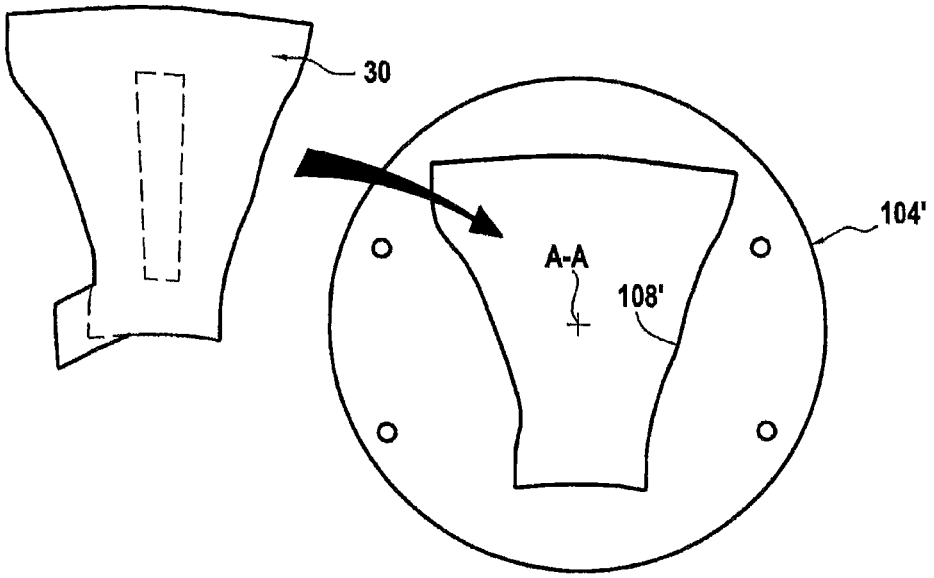
FIG.9
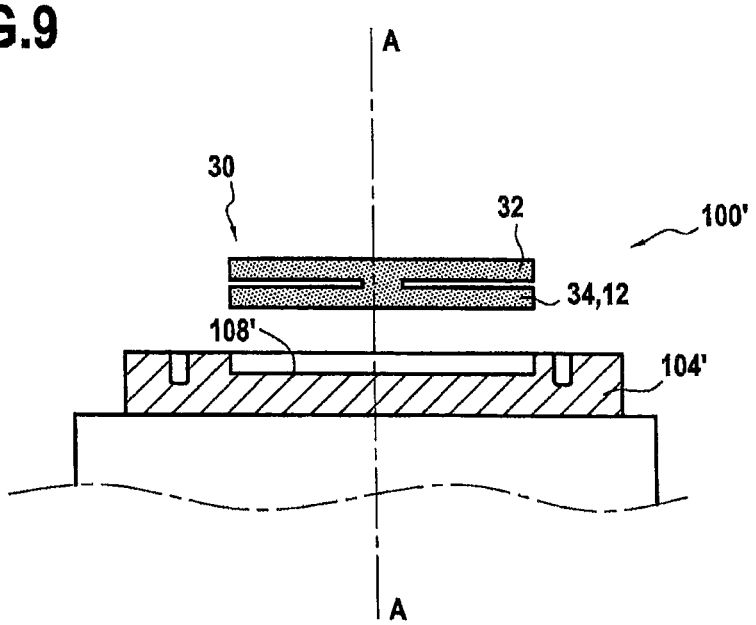

CUTTING TABLE FOR CUTTING A FIBER PREFORM OBTAINED BY THREE-DIMENSIONAL WEAVING, AND A CUTTING METHOD USING SUCH A TABLE

CROSS-REFERENCE TO RELATED APPLICATIONS

This application is the U.S. National Stage of PCT/FR2014/053092, filed Dec. 1, 2014, which in turn claims priority to French patent application number 1362408, filed Dec. 11, 2013. The content of these applications are incorporated herein by reference in their entireties

BACKGROUND OF THE INVENTION

The present invention relates to the general field of fiber preforms obtained by three-dimensional weaving and comprising two distinct portions that present outlines of different shapes and that are connected together by a zone of non-interlinking.

Certain fiber preforms obtained by three-dimensional weaving include zones of non-interlinking that make it possible, using a single flat-woven preform, to make parts out of composite material that are complex in shape. For example, they might be fan blade platforms for an aviation turbine engine that can be obtained from n-shaped fiber preforms having a base and two legs forming stiffeners, the base constituting one portion and the two legs constituting another portion that is distinct from the base portion, the portions being connected together by a zone of non-interlinking.

One of the problems encountered with making such preforms is that the profiles as cut out from the two non-interlinked portions of the preforms (constituting their final outlines) are not necessarily the same. In such a situation, it is not possible to envisage using waterjet cutting, so it is necessary to cut out the profiles of the two portions of the preform manually, one after the other.

However, it is difficult to control manual cutting out of a fiber preform, which can lead to cutting inaccuracies, and to problems of reproducibility and of loss of fibers.

OBJECT AND SUMMARY OF THE INVENTION

An object of the invention is thus to provide a cutting table and a cutting method that do not present the above-mentioned drawbacks.

In accordance with the invention, this object is achieved by a cutting table for cutting out a fiber preform obtained by three-dimensional weaving and having two portions that are connected together by at least one zone of non-interlinking and that present outlines of different shapes, the cutting table comprising: a tabletop provided with a recess for receiving flat one of the portions of the preform to be cut out; sacrificial plates for interposing between the portions of the preform for cutting out and for being fastened to the tabletop; at least one cutting template designed to be pressed against the portion of the fiber preform that is not positioned in the recess; and means for applying compacting pressure against the cutting template.

The cutting table of the invention is remarkable in that it incorporates multiple constraints within a single piece of tooling, such as uniform and accurate compacting of the preform portion while it is being cut out, accurate cutting out of its portions without risk of deformation or fiber removal, and a limited risk of injury for the operator. Thus, the cutting table of the invention makes it easier to cut out fiber preforms and limits problems of reproducibility.

The cutting table may include an actuator mounted vertically above the tabletop and designed to receive the cutting template in order to apply compacting pressure thereagainst.

Each sacrificial plate may be suitable for fastening on the tabletop by means of indexing screws. The recess of the tabletop may present a profile that corresponds to an outline that is common to the two preform portions that are to be cut out.

Advantageously, the cutting template has at least two indexing fingers for positioning it on the preform. Likewise, the cutting template advantageously has a bevelled edge for facilitating the passage of a cutting tool. Finally, the cutting template advantageously has a compacting lip at its periphery for the purpose of optimizing retention of the preform while it is being cut out.

The tabletop is preferably rotary, circular, horizontal, and includes a top surface that is provided with the recess, thereby facilitating the cutting work of the operator.

Another object of the invention is to provide a method of cutting out a fiber preform by means of a cutting table as defined above, the method comprising:

- placing the preform for cutting out on the tabletop of the cutting table while positioning one of the portions of the preform flat in the recess therein;
- placing sacrificial plates between the two portions of the preform and fastening these sacrificial plates to the tabletop of the cutting table;
- placing the cutting template on the portion of the preform that is not positioned in the recess of the tabletop of the cutting table;
- applying compacting pressure against the cutting template;
- cutting out the portion of the preform covered by the cutting template around the outline of the template; and
- repeating the above steps on the other portion of the preform.

The method may include a prior step of pre-cutting the preform by water jet around a common outline covering the outlines of both portions of the preform.

BRIEF DESCRIPTION OF THE DRAWINGS

Other characteristics and advantages of the present invention appear from the following description made with reference to the accompanying drawings, which show an embodiment having no limiting character. In the figures:

FIGS. 2 to 10 are views showing the various steps of the cutting method of the invention as applied to the fiber preform of FIGS. 1A to 1C.

DETAILED DESCRIPTION OF THE INVENTION

The invention relates to cutting out a fiber preform obtained by three-dimensional (3D) weaving and having two portions that are connected together by at least one zone of non-interlinking and that present outlines of different shapes. Such fiber preforms make it possible to make composite material parts of complex shape from a single flat-woven preform. A non-limiting example application is that of fiber preforms used for fabricating fan blade platforms for an aviation turbine engine, such as the preform shown in FIGS. 1A to 1C.

These figures are diagrams showing a fiber preform 10 that is obtained by 3D weaving and that, after shaping, injecting resin or densifying with a matrix, and possibly machining, serves to obtain a fan blade platform.

The term "3D weaving" should be understood as meaning that the warp yarns of the preform follow sinuous paths in order to interlink weft yarns belonging to different weft yarn layers, excepting zones of non-interlinking, it being understood that a 3D weave, in particular an interlock weave, may include 2D weaves at the surface. Various 3D weaves may be used, such as interlock, multi-satin, or multi-plain weaves, for example, as described in particular in document WO 2006/136755.

The fiber preform 10 presents two distinct portions in its thickness direction, namely a top portion 12 and a bottom portion 14, each of which is formed by a plurality of superposed layers of yarns, and which are connected together by a zone of non-interlinking 16 so as to form a single fiber structure. In this zone of non-interlinking 16, the layers of yarns of the top portion of the fiber preform are interlinked with the layers of yarns of the bottom portion (and vice versa).

Figure 1A:
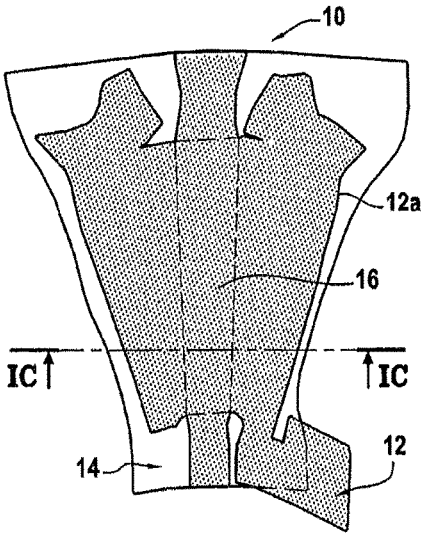
FIGS. 1A and 1B are diagrammatic views from above and below of an example of a fiber preform to which the invention applies.
Figure 1B:
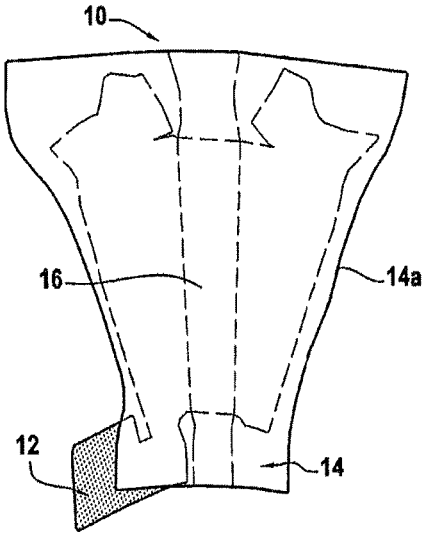

Furthermore, the portions 12 and 14 of the fiber preform present outlines that are different. FIG. 1A shows the outline 12*a* of the top portion 12 of the preform (shaded), while FIG. 1B shows the outline 14*a* of the bottom portion 14 of the preform (with the profile of the top portion drawn in dashed lines).

With reference to FIGS. 2 to 11, there follows a description of the various steps of the cutting method of the invention enabling such a fiber preform to be obtained.

Figure 2:
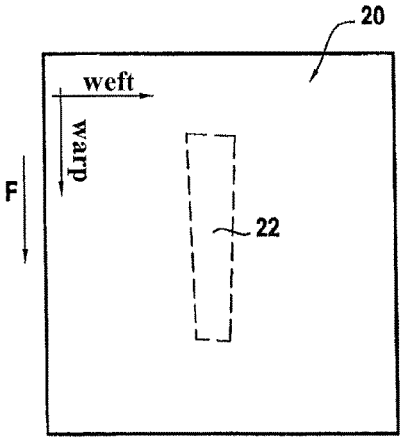
Figure 3:
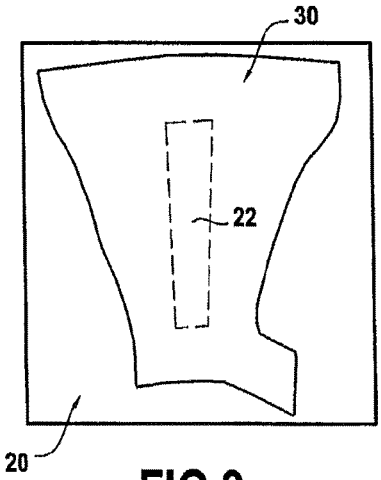
Figure 6:
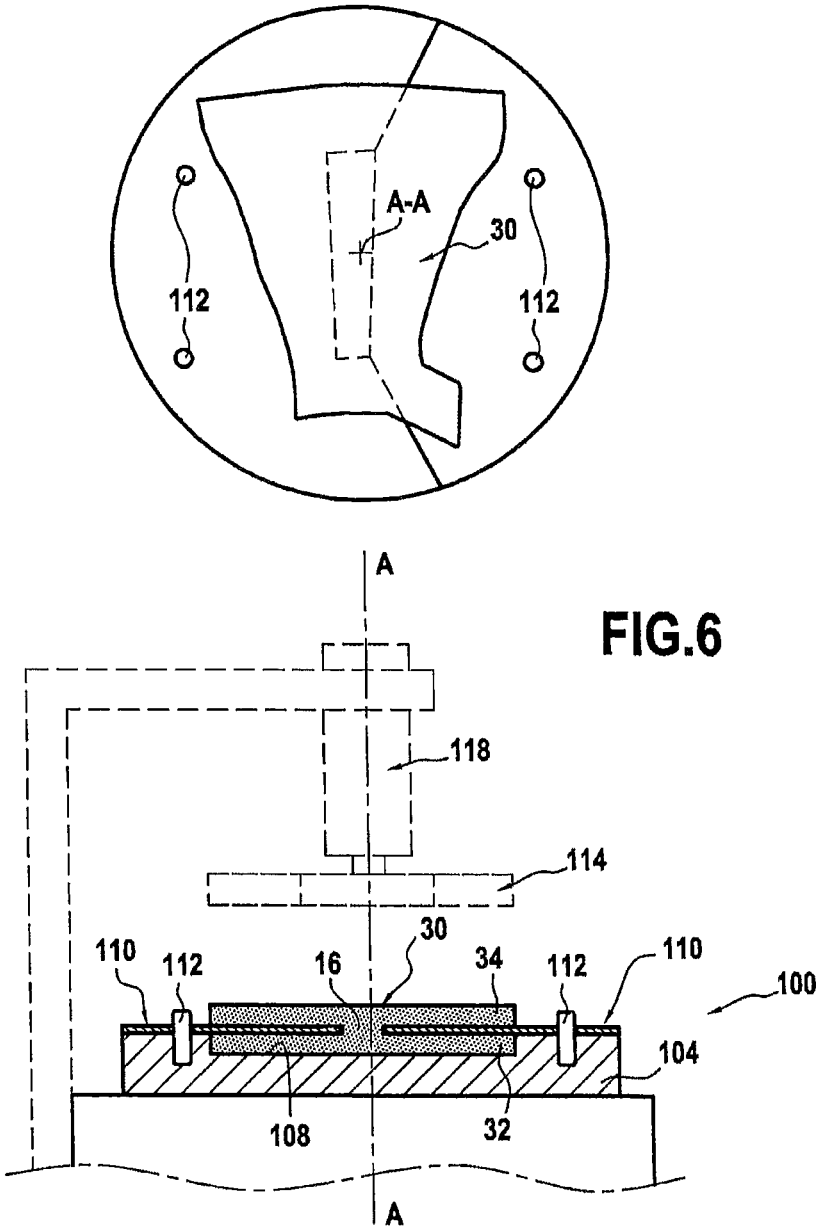

The initial step of the cutting method is making a fiber structure 20 by 3D weaving, such as that shown in FIG. 2, this fiber structure being made up of two distinct portions (in the thickness direction) that are united by a predefined zone of non-interlinking 22. In this figure, there can be seen the warp and weft directions of the yarns constituting the fiber structure, and also the direction F of advance of the structure while it is being woven.

Starting from this fiber structure, the following step consists in pre-cutting the fiber structure with a waterjet along a common outline C that covers the outlines of both of the fiber preform portions that are to be obtained. This operation makes it possible to obtain the pre-cut preform 30 shown in FIG. 3, this pre-cut preform presenting two distinct portions (in the thickness direction) that are connected together by the previously prepared zone of non-interlinking 16.

The preform 30 as pre-cut in this way is then positioned on the cutting table 100 in accordance with the invention, as shown diagrammatically in FIG. 4.

This cutting table 100 comprises in particular a stand 102 on which a horizontal tabletop 104 is mounted to rotate about a vertical axis A-A and that has a top surface 106 provided with a recess 108 that is to receive flat one of the preform portions to be cut out. For this purpose, the recess 108 presents a profile that corresponds to the outline C that is common to both of the preform portions that are to be cut out.

In the example shown in FIG. 4, the portion 32 of the preform 30 that is positioned in the recess 108 of the tabletop 104 of the cutting table is the portion that, after cutting out, is to form the bottom portion of the fiber preform.

Sacrificial plates 110 (there are two in this example) are then interposed between the two preform portions for cutting out (FIG. 5). These sacrificial plates 110 present respective profiles that match the outline of the zone of non-interlinking 16 of the pre-cut preform 30 and they serve to protect the portion 32 of the preform that is positioned in the recess of the tabletop.

Once the sacrificial plates 110 are positioned in this way on the cutting table, they are fastened to its tabletop 104, e.g. each by means of two indexing screws 112 (FIG. 6), thus preventing them from moving during the cutting operation proper.

Figure 7:
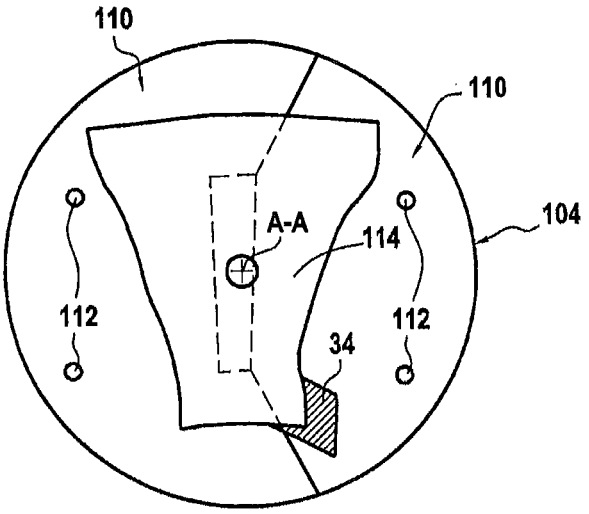
Figure 7:
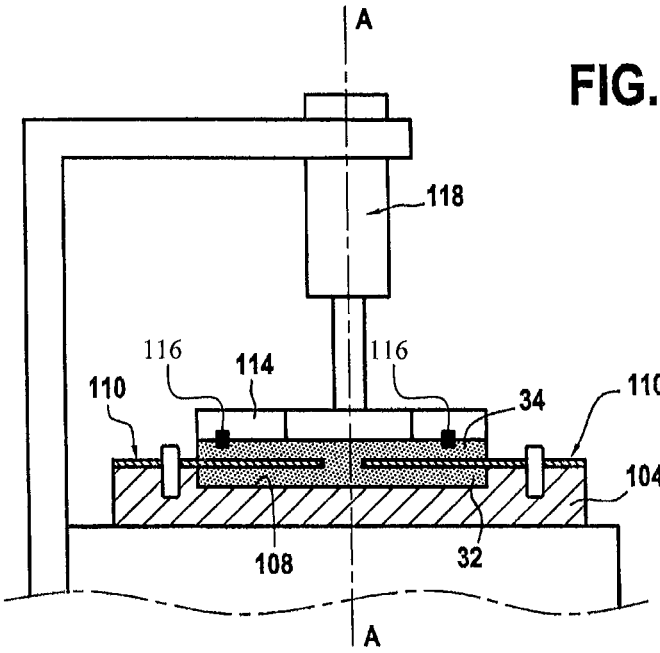

The following step is shown in FIG. 7 and consists in applying a cutting template 114 against the portion 34 of the fiber preform that is not positioned in the recess of the tabletop of the cutting table, which cutting template in this example presents an outline 114*a* that corresponds to the outline of the top portion 12 of the cut-out preform.

Advantageously, the cutting template 114 has two indexing fingers 116 relative to the sacrificial plates 110 in order to ensure that the cutting template is properly positioned on the pre-cut preform 30.

Thereafter, compacting pressure is applied on the cutting template 114 in order to enable the fibers of the preform at the margin of the cutting template to be held so as to prevent them from moving during the cutting operation proper.

For this purpose, the cutting template 114 is fastened horizontally to the free end of an actuator 118 mounted vertically above the tabletop 104 of the cutting table. The compacting pressure applied by the actuator on the cutting template typically lies in the range 3 bars to 5 bars.

Once the cutting template has been applied, it is possible to begin cutting out the portion 34 of the preform along the outline of the cutting template. This cutting can be performed in various ways that are themselves known, for example manually using a blade made of steel or of ceramic.

In the example shown in FIG. 7, the shaded zone of the portion 34 of the fiber preform corresponds to the zone that is to be cut off during this step. It should be observed that turning the tabletop 104 of the cutting table about the vertical axis A-A makes this cutting step easier by enabling the operator always to have access to the cutting zone.

Figure 1C:
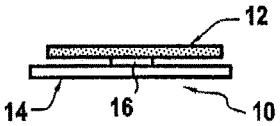
FIG. 1C is a section view on IC-IC of the fiber preform of FIG. 1A.
Figure 8:
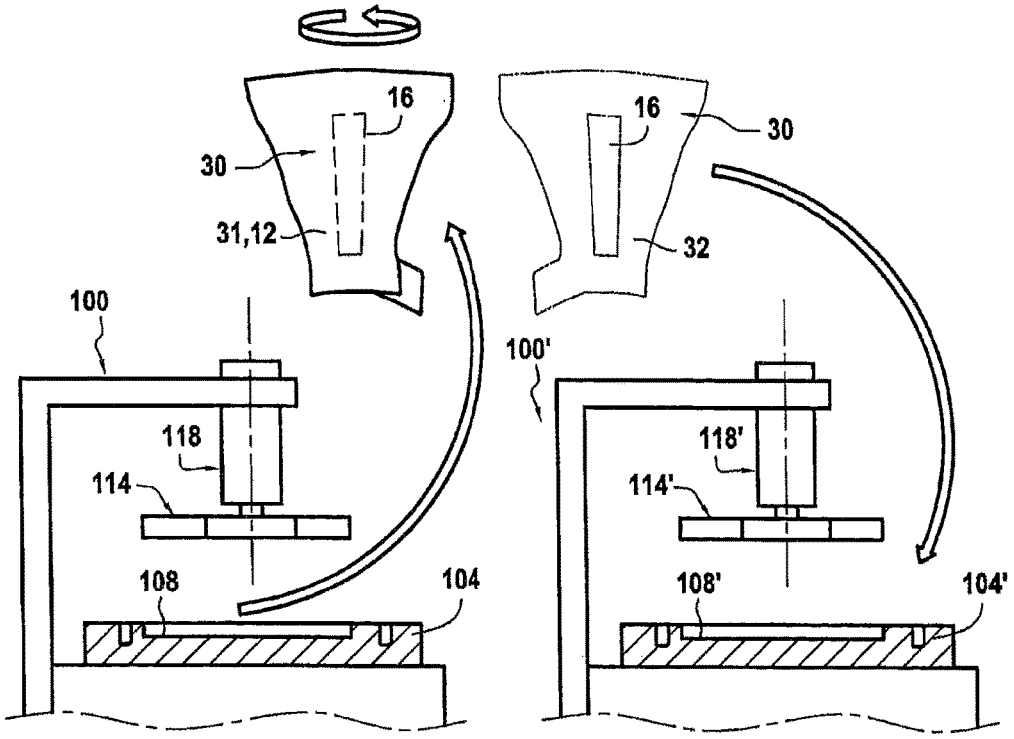

When cutting is finished, the portion 34 of the fiber preform 30 corresponds to the top portion 12 of the cut-out preform 10 as shown in FIGS. 1A to 1C. The cutting template is then removed from the cutting table, and the preform 30 is transferred to another cutting table 100' analogous to the above-described table (FIGS. 8 and 9). This cutting table 100' presents in particular a tabletop 104' having a recess 108' of profile that corresponds to the outline of the portion 34 of the preform that has just been cut out.

The fiber preform 30 is thus placed on the cutting table 100' with its top portion 12 positioned in the recess 108' of the tabletop 104'.

Figure 10:
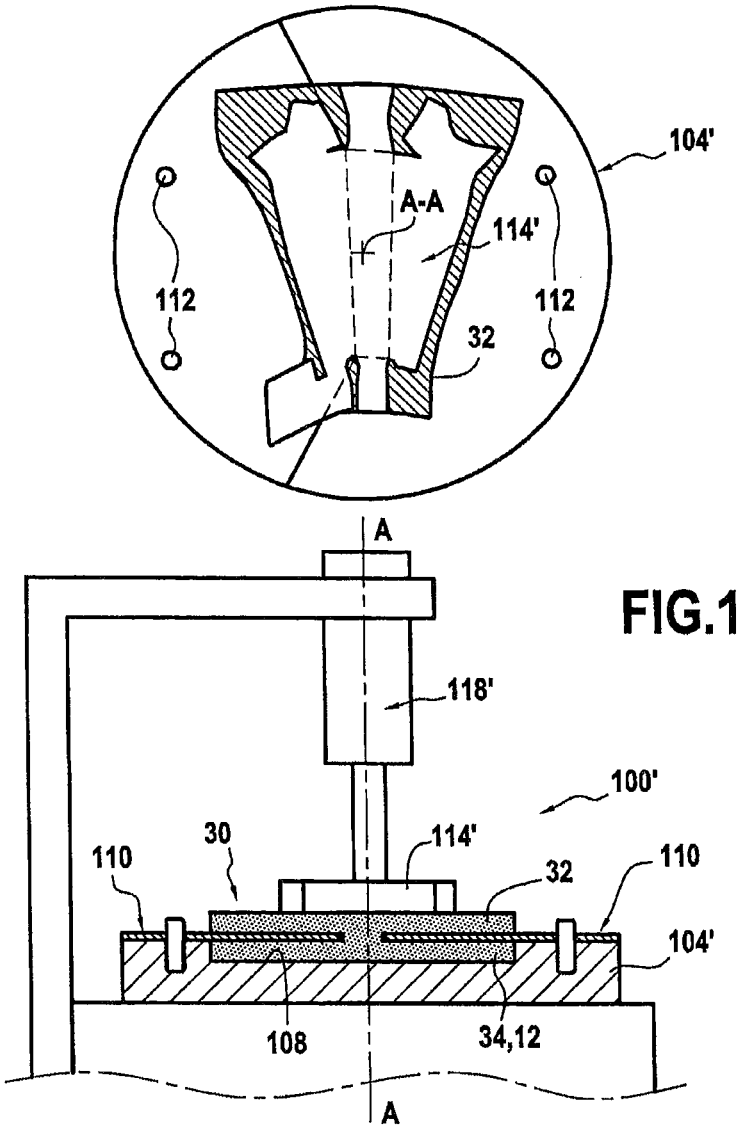

The operations then follow on in the same manner as for cutting out the portion 34 of the preform. In particular, the same sacrificial plates 110 are mounted and fastened to the tabletop 104' and another cutting template 114' is applied against the preform portion 32 to be cut out, this cutting template presenting an outline 114'a that corresponds to the outline of the bottom portion 12 of the cut-out preform (FIG. 10). After applying a compacting pressure by means of an actuator 118', it is possible to begin cutting out the portion 32 of the fiber preform around the outline of this other cutting template 114'. In the example of FIG. 10, the shaded zone of the portion 32 of the fiber preform corresponds to the zone that is cut off.

Once it has been cut out, the portion 32 of the fiber preform 30 corresponds to the bottom portion 14 of the cut-out preform 10 as shown in FIGS. 1A to 1C. The cutting template 114' and the sacrificial plates 110 can then be removed in order to enable the fiber preform to be ejected. It then corresponds to the preform as shown in FIGS. 1A to 1C.

Figure 11:
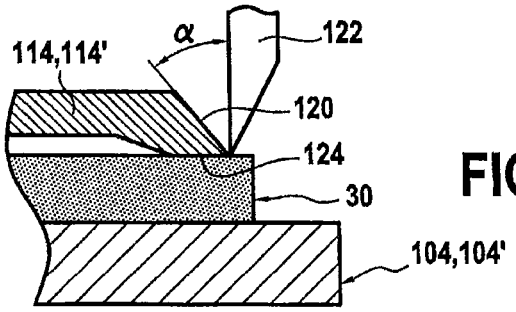
FIG. 11 shows a cutting template for a cutting table of the invention.

In another advantageous provision of the invention, as shown in FIG. 11, each of the cutting templates 114 and 114' has a bevelled edge 120 for facilitating passage of the cutting blade 122. Typically, this bevelled edge 120 may form an angle a of about 45° with the vertical cutting line.

In another advantageous provision of the invention, also shown in FIG. 11, each of the cutting templates 114 and 114' has a compacting lip 124 at its periphery for the purpose of optimizing retention of the preform 30 while it is being cut out. The presence of such a compacting lip 124 (e.g. having a width of about 5 millimeters (mm)) thus serves to limit the application of pressure to a zone situated around the zone for cutting.

The invention claimed is:

1. A cutting table for cutting out a fiber preform obtained by three-dimensional weaving and having two portions that are connected together by at least one zone of non-interlinking and that present outlines of different shapes, the cutting table comprising:

a tabletop provided with a recess for receiving one of the portions of the fiber preform to be cut out, said fiber preform being capable of laying flat in said recess;

two separate sacrificial plates for interposing between the portions of the fiber preform for cutting out, each of said two separate sacrificial plates being configured to be separately fastened to the tabletop, said two separate sacrificial plates covering partially the recess of the tabletop when the two sacrificial plates are fastened to the tabletop, wherein a first surface of said tabletop is constructed and arranged to receive a first of the two separate sacrificial plates and a second surface of said tabletop, which is different from the first surface, is configured to receive a second of the two separate sacrificial plates so that the two separate sacrificial plates are simultaneously mountable to the tabletop;

at least one cutting template configured to be pressed against a portion of the fiber preform that is positioned outside of the recess; and means for applying compacting pressure against the cutting template.

2. A cutting table according to claim 1, wherein the means for applying compacting pressure includes an actuator mounted vertically above the tabletop and configured to receive the cutting template in order to apply compacting pressure there against.

3. A cutting table according to claim 1, wherein each sacrificial plate is for fastening on the tabletop by means of indexing screws.

4. A cutting table according to claim 1, wherein the cutting template has at least two indexing fingers for positioning the cutting template on the fiber preform.

5. A cutting table according to claim 1, wherein the cutting template has a beveled edge for facilitating the passage of a cutting tool.

6. A cutting table according to claim 1, wherein the cutting template has a compacting lip at its periphery for the purpose of optimizing retention of the fiber preform while it is being cut out.

7. A cutting table according to claim 1, wherein the recess of the tabletop presents a profile that corresponds to an outline that is common to the two preform portions that are to be cut out.

8. A cutting table according to claim 1, wherein the tabletop is rotary, circular, horizontal, and includes a top surface that is provided with the recess.

9. A method of cutting out a fiber preform by means of a cutting table, the fiber preform being obtained by three-dimensional weaving and having two portions that are connected together by at least one zone of non-interlinking and that present outlines of different shapes, the cutting table including a tabletop provided with a recess for receiving one of the portions of the fiber preform to be cut out, said fiber preform being capable of laying flat in said recess, sacrificial plates for interposing between the portions of the fiber preform for cutting out and for being fastened to the tabletop; a cutting template configured to be pressed against a portion of the fiber preform that is positioned outside of the recess; and means for applying compacting pressure against the cutting template, the method comprising:

placing the fiber preform for cutting out on the tabletop of the cutting table while positioning one of the portions of the fiber preform flat in the recess therein;

placing the sacrificial plates between the two portions of the fiber preform and fastening the sacrificial plates to the tabletop of the cutting table;

placing the cutting template on the portion of the fiber preform that is positioned outside the recess of the tabletop of the cutting table;

applying compacting pressure against the cutting template;

cutting out the portion of the fiber preform covered by the cutting template around the outline of the template; and repeating the above steps on the other portion of the fiber preform.

10. A method according to claim 9, including, prior to placing the fiber preform for cutting out on the tabletop, pre-cutting the preform by water jet around a common outline covering the outlines of both portions of the preform.

11. A method according to claim 9, wherein the compacting pressure is applied by an actuator mounted vertically above the tabletop.

12. A method according to claim 9, wherein each sacrificial plate is fastened on the tabletop by means of indexing screws.

13. A method according to claim 9, wherein the cutting template has at least two indexing fingers for positioning the cutting template on the fiber preform.

14. A method according to claim 9, wherein the cutting template has a beveled edge for facilitating the passage of a cutting tool.

15. A method according to claim 9, wherein the cutting template has a compacting lip at its periphery for the purpose of optimizing retention of the fiber preform while it is being cut out.

16. A method according to claim 9, wherein the recess of the tabletop presents a profile that corresponds to an outline that is common to the two preform portions that are to be cut out.

17. A method according to claim 9, wherein the tabletop is rotary, circular, horizontal, and includes a top surface that is provided with the recess.

* * * * *